US005382023A

United States Patent [19]

Roberts et al.

[11] Patent Number: 5,382,023

[45] Date of Patent: Jan. 17, 1995

[54] RANDOM NUMBER GENERATOR WITH SPRING PROPELLED ROTATING WHEELS

[76] Inventors: John W. Roberts; Ramoth G. Roberts, both of 496 Lakeshore Dr., St. Augustine, Fla. 32095

[21] Appl. No.: 138,727

[22] Filed: Oct. 20, 1993

[51] Int. Cl.[6] ..... A63F 9/00

[52] U.S. Cl. ..... 273/142 H; 273/143 R; 273/142 JC

[58] Field of Search ..... 273/142 R, 143 R, 143 C, 273/143 D, 142 H, 142 JC, 144 R, 144 B, 138 A, 155, 148 R, 269; 446/236, 241, 260

[56] References Cited

U.S. PATENT DOCUMENTS

| | | | |
|---|---|---|---|
| 569,130 | 10/1896 | Haverly | 273/143 R |
| 592,087 | 10/1897 | French | 273/142 H |
| 1,979,459 | 11/1934 | Finn | 273/143 R |
| 2,810,211 | 10/1957 | Zegbaugh | 273/142 H |

*Primary Examiner*—Vincent Millin
*Assistant Examiner*—William M. Pierce
*Attorney, Agent, or Firm*—E. Michael Combs

[57] ABSTRACT

A random number generator structure is arranged to include a plurality of wheels to generate a like plurality of numbers, wherein the wheels are arranged within a tubular housing and rotatably mounted within the housing arranged for spinning within the housing for viewing of individual numbers through an individual window associated with each respective wheel.

1 Claim, 4 Drawing Sheets

RANDOM NUMBER GENERATOR WITH SPRING PROPELLED ROTATING WHEELS

BACKGROUND OF THE INVENTION

1. Field of the Invention

The field of invention relates to random number generator structure, and more particularly pertains to a new and improved random number general or wherein the same is arranged for ease of transport and use for generating random numbers relative to games of chance.

2. Description of the Prior Art

The prior art has indicated random number generator structure such as indicated in U.S. Pat. Nos. 4,984,796; 4,886,271; and 5,123,648, as well as the U.S. Pat. No. 4,801,145.

The instant invention attempts to overcome deficiencies of the prior art by providing for a structure having planar forward and rear walls arranged for ease of transport and mounting within an individual's pocket and the like for use in generating numbers in play of various games of chance and in this respect, the present invention substantially fulfills this need.

SUMMARY OF THE INVENTION

The present invention provides a random number generator structure arranged to include a plurality of wheels to generate a like plurality of numbers, wherein the wheels are arranged within a tubular housing and rotatably mounted within the housing arranged for spinning within the housing for viewing of individual numbers through an individual window associated with each respective wheel.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved random number generator which has all the advantages of the prior art random number generator structure and none of the disadvantages.

It is another object of the present invention to provide a new and improved random number generator which may be easily and efficiently manufactured and marketed.

It is a further object of the present invention to provide a new and improved random number generator which is of a durable and reliable construction.

An even further object of the present invention is to provide a new and improved random number generator which is susceptible of a low cost of manufacture with regard to both materials and labor, and which accordingly is then susceptible of low prices of sale to the consuming public, thereby making such random number generators economically available to the buying public.

Still yet another object of the present invention is to provide a new and improved random number generator which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
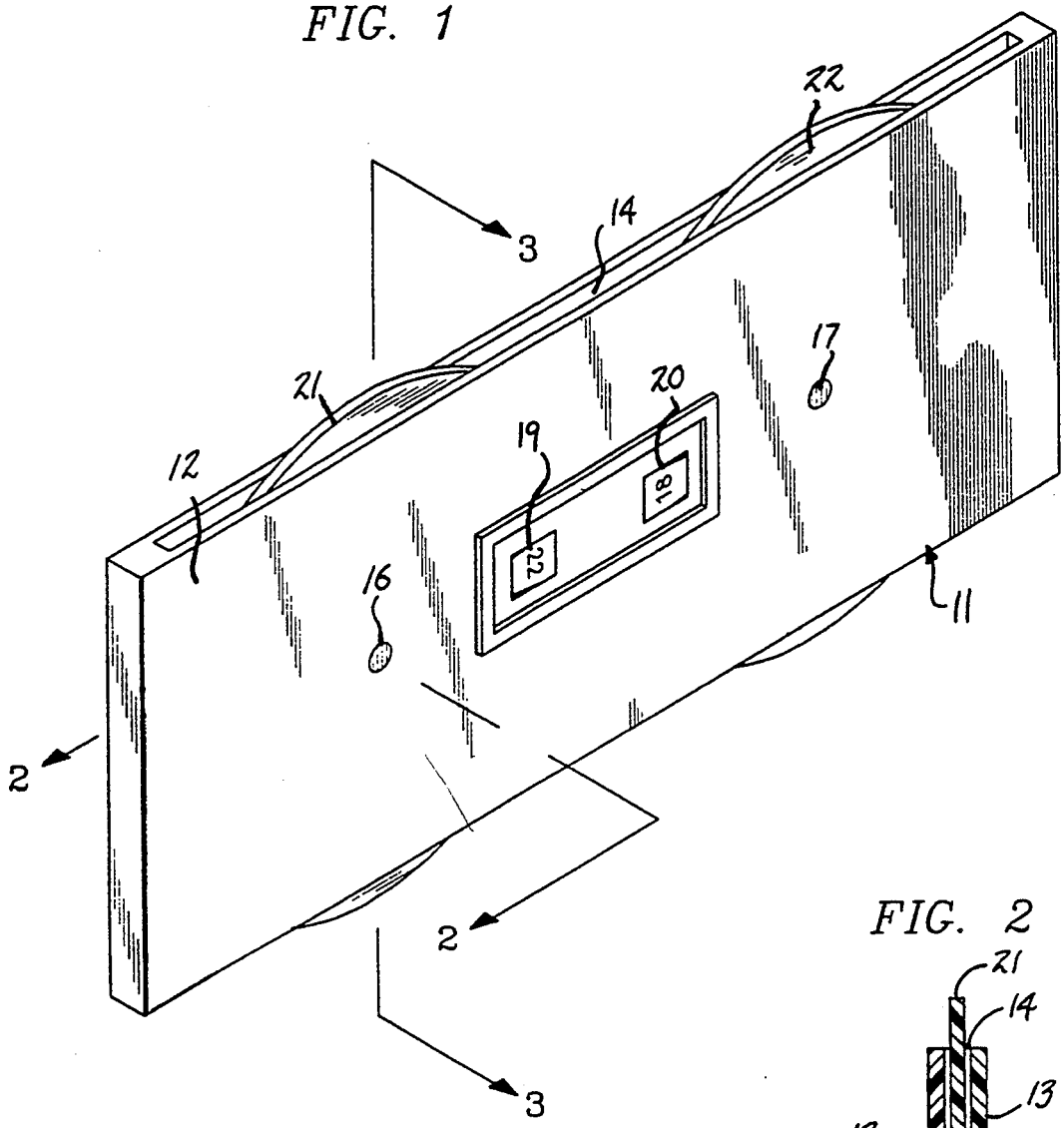
FIG. 1 is an isometric illustration of the invention.
Figure 2:
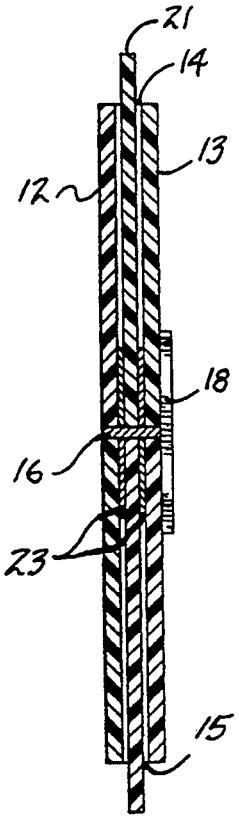
FIG. 2 is an orthographic view, taken along the lines 2—2 of FIG. 1 in the direction indicated by the arrows.

With reference now to the drawings, and in particular to FIGS. 1 to 7 thereof, a new and improved random number generator embodying the principles and concepts of the present invention and generally designated by the reference numerals 11–34 will be described.

Figure 3:
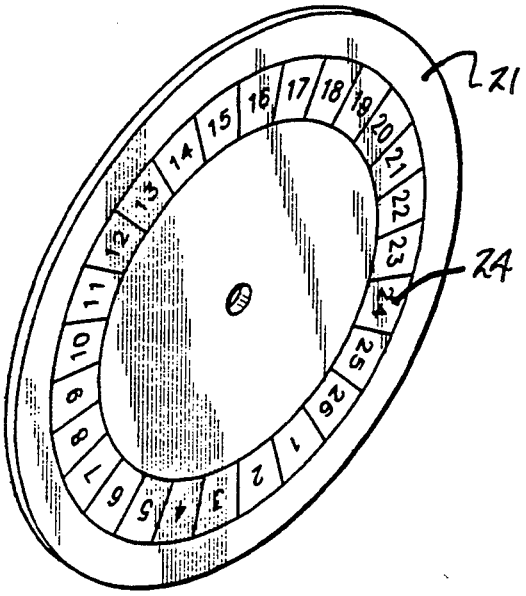
FIG. 3 is an orthographic view, taken along the lines 3—3 of FIG. 1 in the direction indicated by the arrows.

More specifically, the random number generator of the instant invention essentially comprises a tubular housing, 11 including spaced parallel front and rear walls 12 and 13 respectively arranged in a coextensive relationship relative to one another defining a central housing cavity having a first entrance opening 14 spaced from a second entrance opening 15, with respective first and second axles 16 and 17 parallel relative to one another and orthogonally directed through the housing cavity and through the front and rear walls 12 and 13. The tubular housing as illustrated defines a generally rectilinear cross-sectional configuration. The first and second axles 16 and 17 each include respective axle mounting flanges 18 to provide for fixed securement of each respective axle to the housing rear wall providing for an enhanced engaging surface for use of adhesives and the like for securing the mounting flange relative to the housing rear wall. Respective first and second annular discs 21 and 22 are rotatably mounted about the respective first and second axles 16 and 17, with the first and second annular discs 21 and 22 projecting beyond the first and second entrance openings 14 and 15 of the housing cavity. Further, first and second window openings 19 and 20 are directed through the front wall 12, each spaced a predetermined radius relative to a respective first and second axle 16 and 17. In this manner, each of the manual access to an outer periphery of the first and second discs permits ease of manual access to the outer periphery of the first and second discs for ease of rotation about their respective axles. With reference to FIG. 3 for example, each of the wheels includes an annular numerical array 24 spaced from the wheel axis a predetermined radius equal to the predetermined radius of the first and second windows relative to the first and second axles to provide for positioning of one of the numbers of the numerical array through an associated window. In this manner, an individual merely rotates the wheels relying on inertia to randomly generate numbers viewed through the windows or window openings 19 and 20. Further, bearing plates 23 and 24 are mounted on opposed sides of each of the annular discs, with the bearing plates positioned to receive an individual axle therethrough. The bearing plates may be formed of various materials to include Teflon ®.

Figure 4:
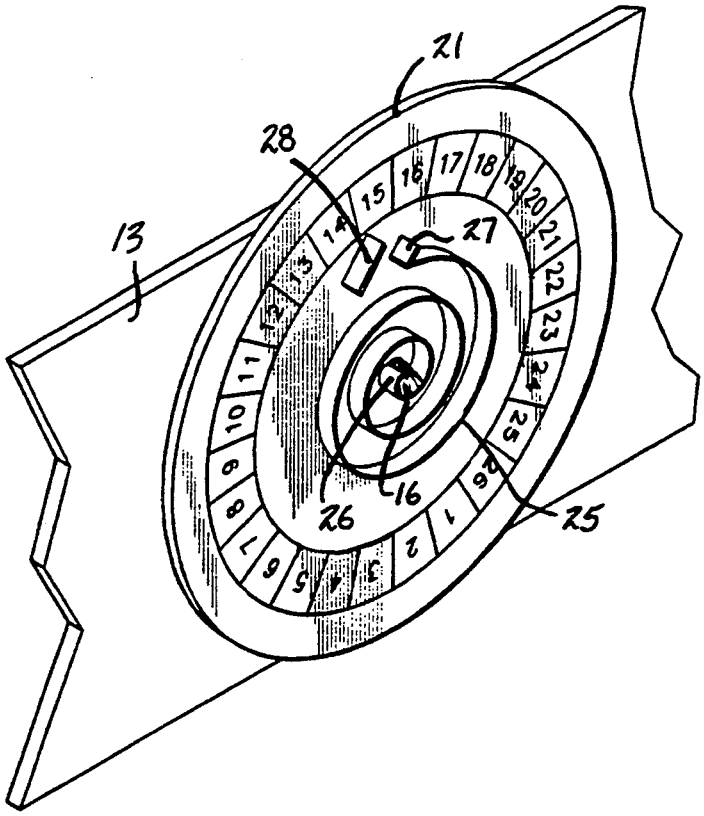
FIG. 4 is an isometric illustration of a modified wheel member structure for use by the invention.

The FIG. 4 indicates a modified wheel structure to include a helical spring 25 having a spring first end 26 spaced from a spring second end 27. The spring first end 26 is secured to an individual axle, in this case the first axle 16, with the spring second end 27 of a V-shaped configuration arranged to be secured to an engaging flange 28 fixedly mounted to the disc 21. In this manner, the V-shaped second end 27 engages the engaging flange 28 permitting manual winding and tension of the spring 25. Upon release of the disc 21, the spring second end 27 separates from the flange 28 and merely passes the flange during rotation of the wheel, with inertia forcing the second end flange 27 beyond the flange 28 for generation of various numbers from the numerical array 24.

Figure 5:
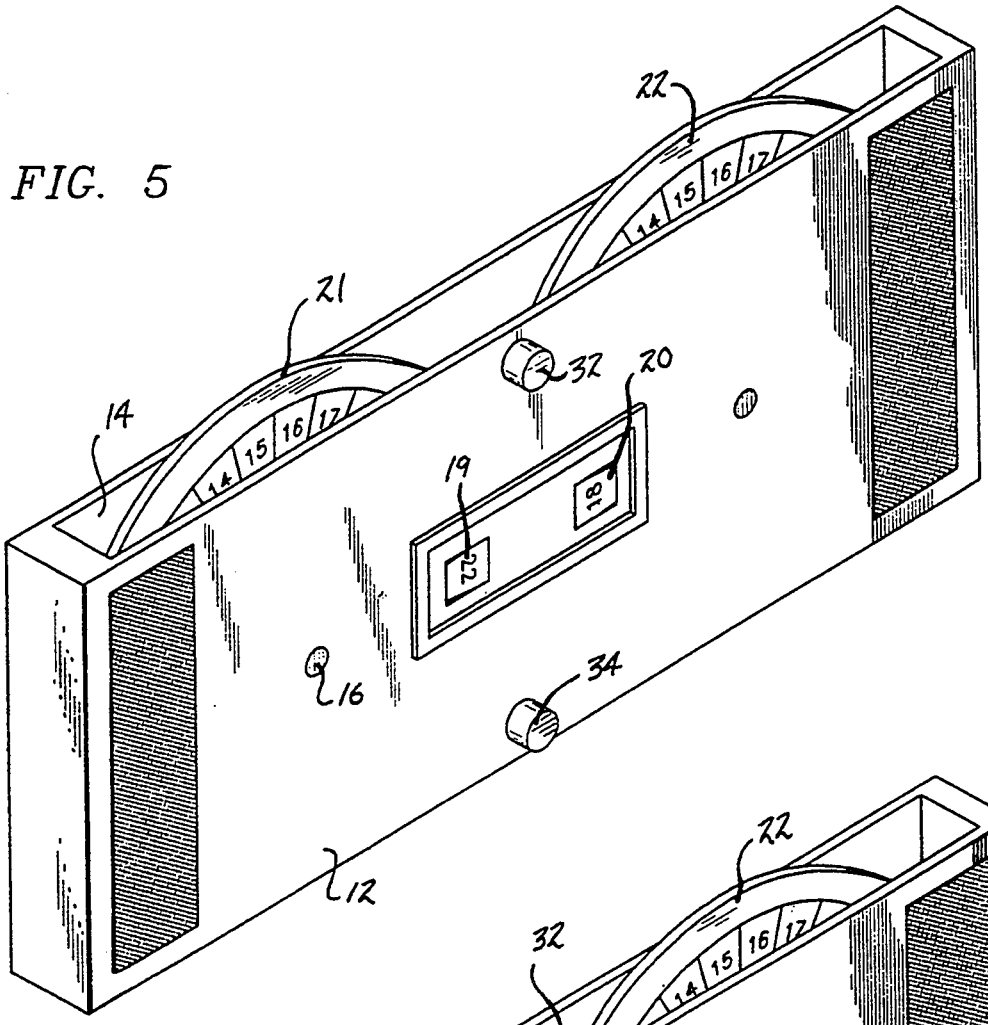
FIG. 5 is an isometric illustration of a modified aspect of the invention employing gear driven wheels.
Figure 6:
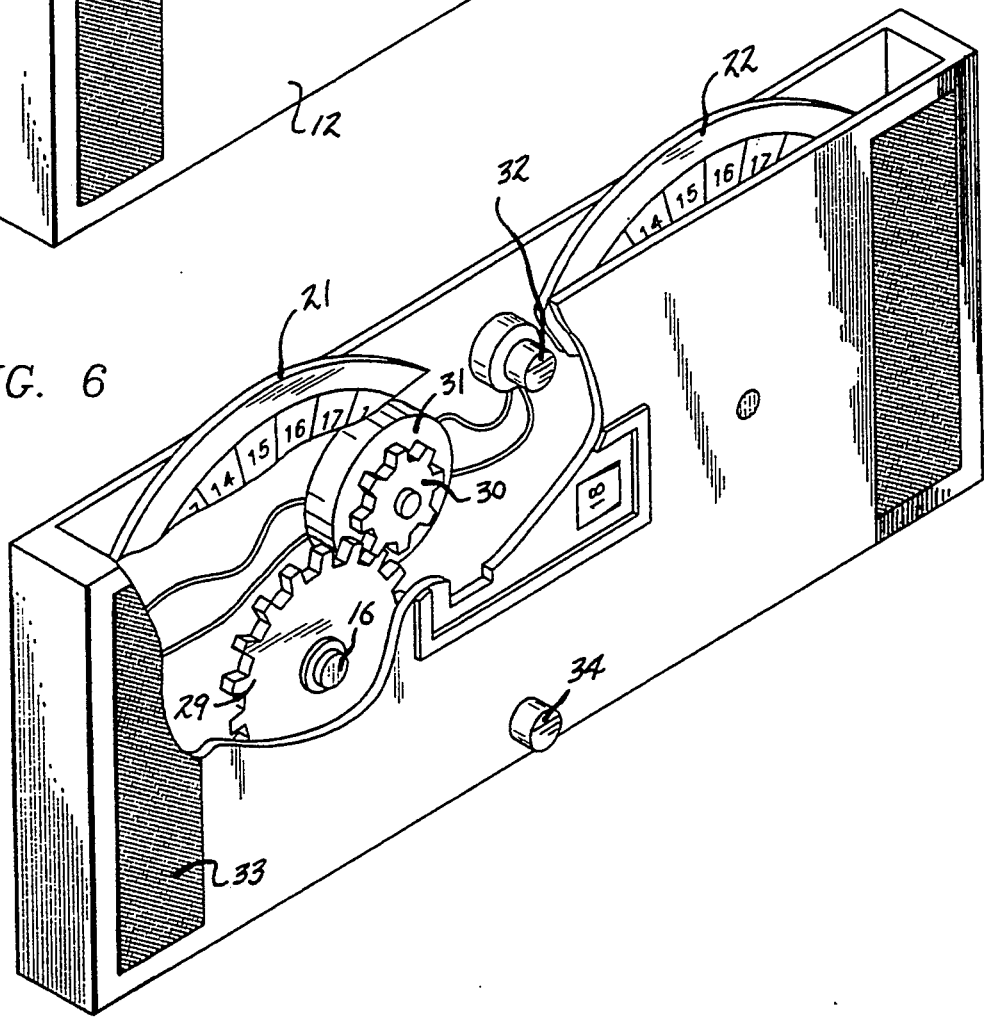
FIG. 6 is an isometric illustration, partially in cross-section, to indicate the drive structure of an individual wheel relative to the housing.
Figure 7:
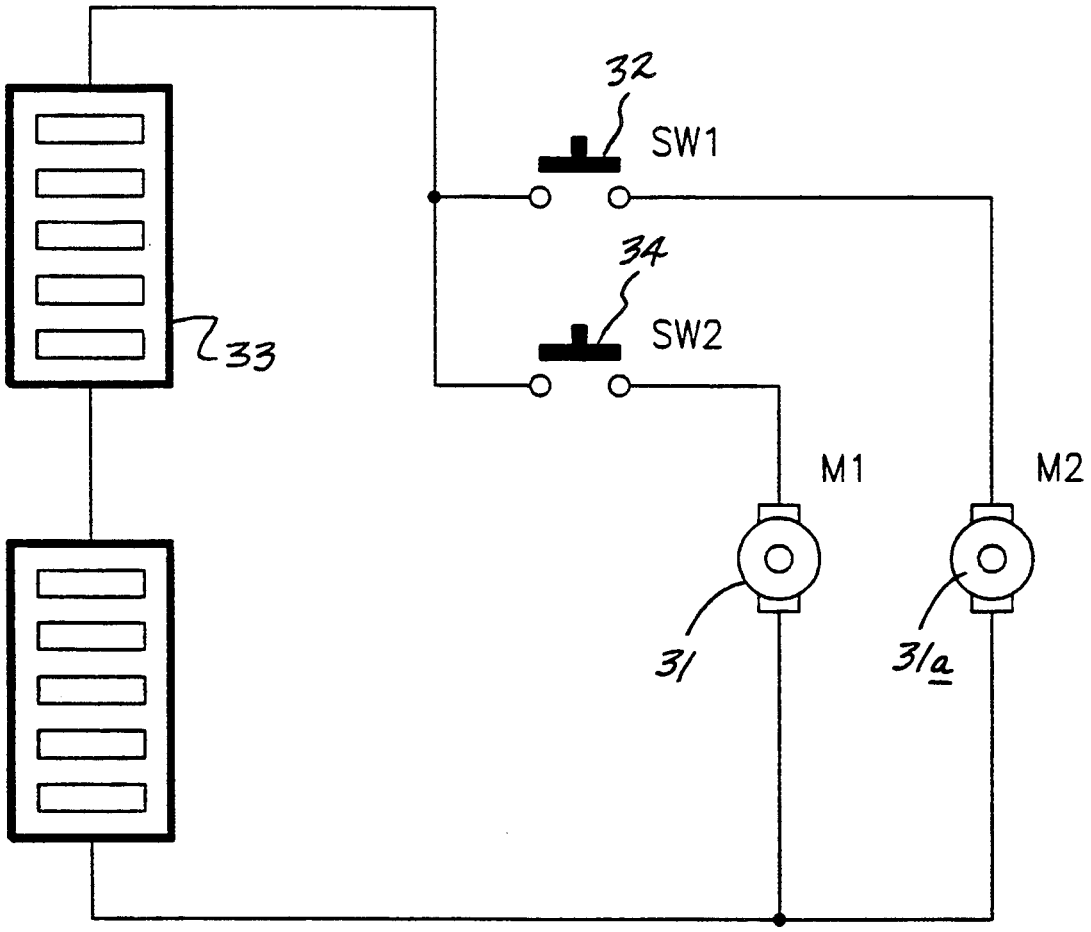
FIG. 7 is an electrical diagrammatic illustration indicating application of power to the individual wheels of the device.

The FIGS. 5 and 6 indicate the use of the respective first and second axles, each having a first gear 29 mounted thereto, with the first and second gears 29 arranged for engagement with respective second gears 30. In this configuration, the respective first and second axles are fixedly secured to the first and second discs, whereupon first and second drive motors 31 and 31*a* respectively operative through respective first and second switches 32 and 34, through respective solar cells 33 driving the discs for generation of numbers through the associated first and second windows 19 and 20.

It should be further noted that relative to the configuration of a disc of FIG. 4, the first and second axles 16 and 17 are also fixedly secured to the first and second discs 21 and 22 respectively. Further, should the annular disc 21 and 22 of the FIGS. 1 and 2 be fixedly secured to respective first and second axles 16 and 17, then the first and second axles could alternatively be rotatably directed through the housing front and rear walls 12 and 13.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A random number generator, comprising, a rigid tubular housing, said housing including a front wall spaced from a rear wall, with the front wall and rear wall arranged in a parallel coextensive relationship, the housing including a housing cavity oriented between the front wall and the rear wall, and a first entrance opening directed into the cavity at a first end of the cavity, and a second entrance opening directed into the cavity at a second end of the cavity, at least one axle directed through the housing and through the cavity extending orthogonally through the front wall and the rear wall, the axle secure to the front wall and the rear wall, and an annular disc fixedly mounted to the axle within the cavity, and the disc being rotatably mounted about the axle, with the disc directing exteriorly of the cavity and extending beyond the first entrance opening and the second entrance opening for ease of manual grasping of the annular disc, the disc including an annular numerical array concentric relative to the axle, with the numerical array in facing relationship relative to the front wall from within the cavity, and the disc having an outer annular periphery, the numerical array spaced a predetermined radius relative to the first axle, and the numerical array positioned between the axle and the annular periphery, and at least one window directed through the front wall spaced said predetermined radius from the axle, and further including a helical spring, the helical spring having a first end fixedly secured to the axle, and a second end, the second end having a V-shaped hook, and an engaging flange fixedly secured to the disc in facing relationship relative to the front wall from within the cavity, and the V-shaped hook releasably receiving the engaging flange therewithin permitting manual winding of the disc about the axle, and subsequent release of the flange from the hook upon manual release of the disc.

* * * * *